US006739267B2

(12) United States Patent
Fichtner et al.

(10) Patent No.: US 6,739,267 B2
(45) Date of Patent: May 25, 2004

(54) MOVEABLE TRACK CONNECTION

(75) Inventors: Karl Fichtner, München (DE); Franz Pichlmeier, Taufkirchen (DE); Michael Schöttl, München (DE)

(73) Assignee: Thyssenkrupp Transrapid GmbH, Kassel (DE)

( * ) Notice: Subject to any disclaimer, the term of this patent is extended or adjusted under 35 U.S.C. 154(b) by 0 days.

(21) Appl. No.: 10/276,969

(22) PCT Filed: Jun. 1, 2001

(86) PCT No.: PCT/EP01/06224

§ 371 (c)(1),
(2), (4) Date: Nov. 20, 2002

(87) PCT Pub. No.: WO02/02874

PCT Pub. Date: Jan. 10, 2002

(65) Prior Publication Data

US 2003/0154878 A1 Aug. 21, 2003

(51) Int. Cl.[7] ..... E01B 25/00
(52) U.S. Cl. ..... 104/130.11
(58) Field of Search ..... 104/130.11, 130.03, 104/96, 99, 100, 101, 130.01, 130.02, 130.04

(56) References Cited

U.S. PATENT DOCUMENTS

| | | | | |
|---|---|---|---|---|
| 3,635,166 A | * | 1/1972 | Peterson | 104/130.04 |
| 6,324,991 B1 | * | 12/2001 | Friedrich et al. | 104/130.01 |
| 6,354,225 B1 | * | 3/2002 | Fichtner et al. | 104/130.03 |

FOREIGN PATENT DOCUMENTS

| | | | |
|---|---|---|---|
| DE | 44 16 819 | | 1/1998 |
| DE | 196 31 324 | | 5/1998 |
| DE | 198 00 909 | | 8/1999 |
| DE | 198 00 908 | | 9/1999 |
| GB | 883095 | | 11/1961 |
| JP | 2159906 | * | 6/1990 |
| JP | 4202901 | * | 7/1992 |

* cited by examiner

*Primary Examiner*—Mark T. Le
(74) *Attorney, Agent, or Firm*—McGlew and Tuttle, P.C.

(57) ABSTRACT

A movable track connection between the ends of travel paths for wrap-around track-guided vehicles, especially magnetic levitation railway vehicles is provided. The moveable track connection has a set of S-shaped deformable bending points (1) for changing track. A bearing (4, 6) along half the length of deformable bending points has a vertical axis of rotation, which cannot move in the longitudial direction of the bending points (1).

20 Claims, 4 Drawing Sheets

MOVEABLE TRACK CONNECTION

FIELD OF THE INVENTION

The invention relates to a moveable track connection between the ends of travel paths for wrap-around track guided vehicles, especially magnetic levitation railway vehicles.

BACKGROUND OF THE INVENTION

Such track connections serve both for changing the travel path of a vehicle to the neighboring track route and as track connection between the two ends of one and the same travel path.

A track connection is described in DE 44 16 819 C2, wherein a bending girder is elastically bendable from each end of travel path in the direction of the end of the neighboring travel path, with it being possible to align the bendable ends of said track connection flush to each other in order to form the track connection. The girders border the elastically bendable end of the bending girder and can be elastically bent away from the neighboring travel path to the outside. To allow for a change of track on a neighboring travel path, it is necessary to bend both the two outer travel path ends outwardly and to bend the two travel path ends inwardly. A multitude of bending facilities is required to this effect which have to execute differently great movements at different spots.

From DE 196 31 324 C 1 a transition connection between travel paths for wraparound track-guided vehicles is known. Bending points with several homologous moveable travel path elements do exist which run in parallel to each other and which are mechanically hinged by several connecting elements or logically, functionally connected to each other. In this transition connection, too, at least four travel path ends are designed and operated as bending points.

Moreover DE 198 00 908 C 1 and DE 198 00 909 C 1 describe a change of track facilities for travel paths of a magnetic levitation railway. For the build-up of the change of track facility the ends of the involved travel paths are executed as bending girders. The support of the connection girders is effected in a deformation-free manner. To this effect, pivot bearings are provided between the normal travel path and the transition elements which can be arrested for bending.

According to these embodiments belonging to the state of the art in technology, the ends of two bending points each are connected to each other, with the connection of the two oppositely loaded bending points being problematic and with it being required to bridge a relatively large expansion gap. Special flap bridges are used for bridging this expansion gap.

SUMMARY OF THE INVENTION

It is an object of this invention to provide a moveable track connection that overcomes the aforementioned problems and especially avoids unsteadiness at transition spots.

According to the invention a set of S-shaped deformable bending points including change of curve is provided for changing track. The bending points are comprised of a bearing with a vertical pivot axis at half its length. The bearing is non-moveable in the longitudinal direction of the bending points. The special advantage of the subject of this invention is that it is not necessary to lock two ends of the bending points (moveable bearing) against each other as required according to the state of the art in this technology. Instead only one end of a bending points is locked against the fixed end (fixed bearing) of the travel path. By allocating the moveable bearings to the two ends of the bending points, the expansion gap is substantially reduced so that the flap bridges for bridging the expansion gap can be of a much simpler and smaller configuration or can even be dispensed with entirely. Moreover, unsteadiness in the bending curve at the transition due to temperature and vehicle impacts is largely avoided and/or substantially reduced as compared with hitherto existing solutions. By the use of only one set of bending points it is moreover achieved that one fixed bearing can be deleted as compared with hitherto existing configurations.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENTS

Figure 1A:
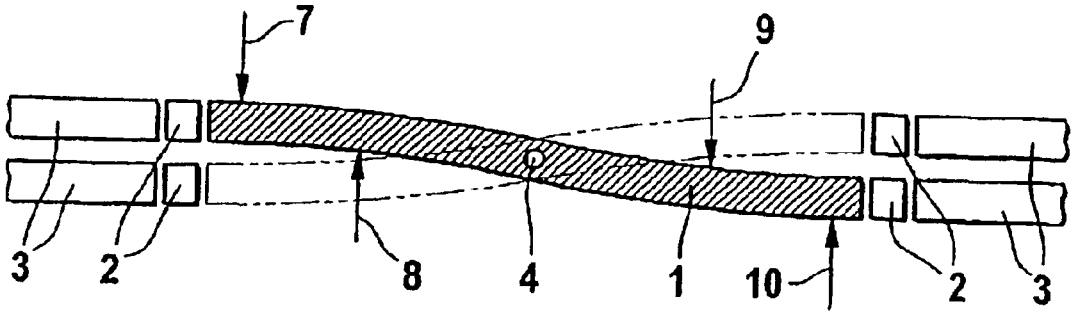
FIG. 1*a* is a top view showing a change of track with a diamond crossing in a first change of track function.

Referring to the drawings in particular, the figures show a set of bending points 1 represented on the one hand as a straight track connection and on the other hand as an S-shaped connection with different curve direction. The set of bending points 1 is connected each via an abutment 2 to the ends of the travel paths 3.

Figure 1B:
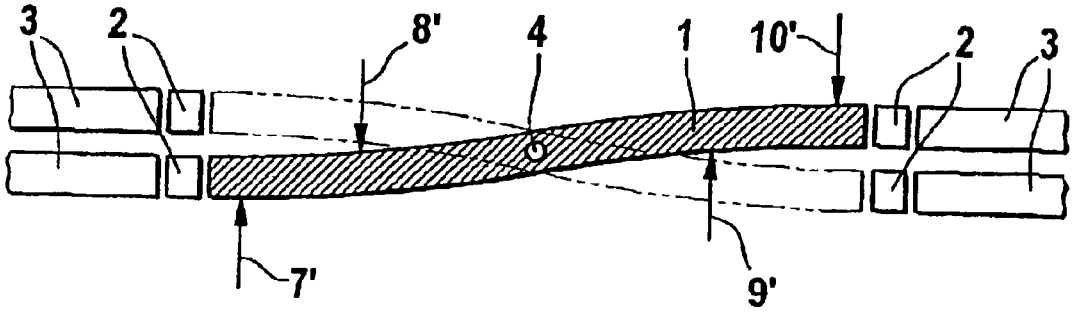
FIG. 1*b* is a top view showing a change of track with a diamond crossing in a second change of track function.
Figure 2A:
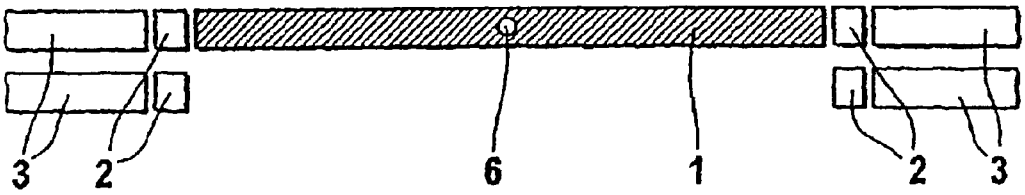
FIG. 2*a* is a top view showing a track connection and change of track with shunting points in a first track connection function.
Figure 2B:
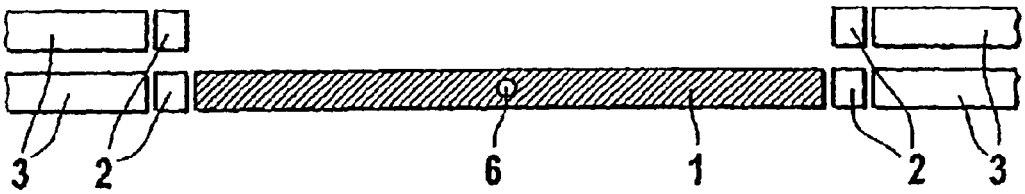
FIG. 2*b* is a top view showing a track connection and change of track with shunting points in a second track connection function.
Figure 2C:
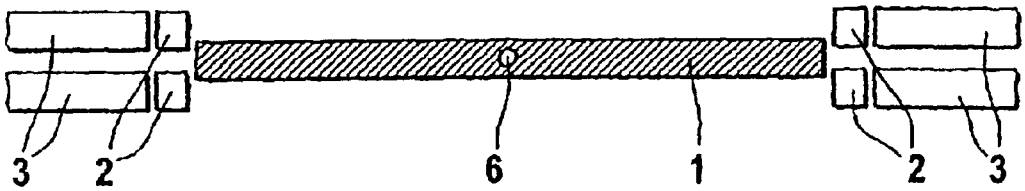
FIG. 2*c* is a top view showing a track connection and change of track with shunting points in an intermediate position for the functional change of the track connection function in track change function and vice-versa.
Figure 2D:
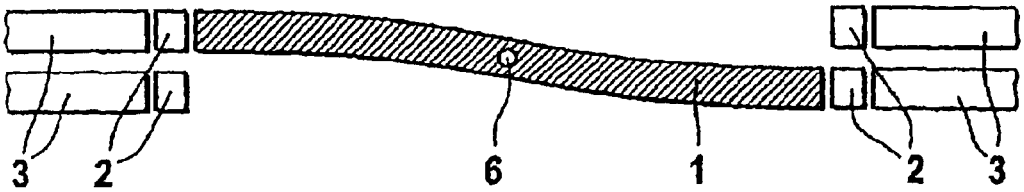
FIG. 2*d* is a top view showing a track connection and change of track with shunting points in a first track change function.
Figure 2E:
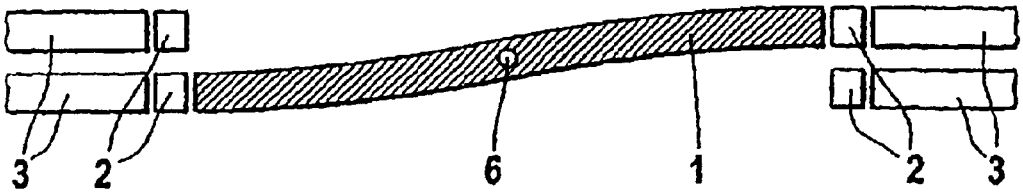
FIG. 2*e* is a top view showing a track connection and change of track with shunting points in a second track change function.
Figure 3A:
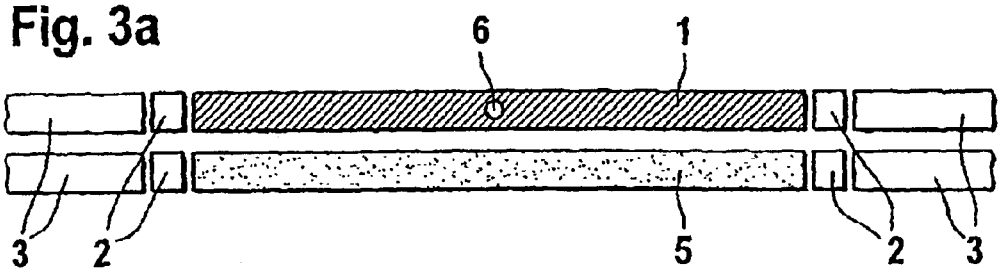
FIG. 3*a* is a top view showing the transition point with shunting points and sliding girder in a double track connection function.
Figure 3B:
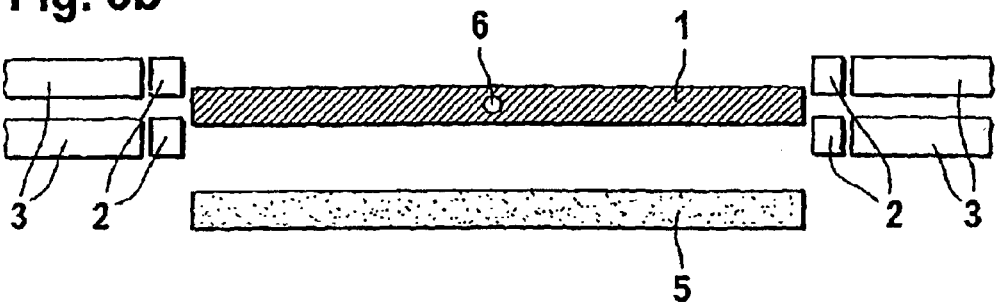
FIG. 3*b* is a top view showing the transition point with shunting points and sliding girder in an intermediate position for functional change.
Figure 3C:
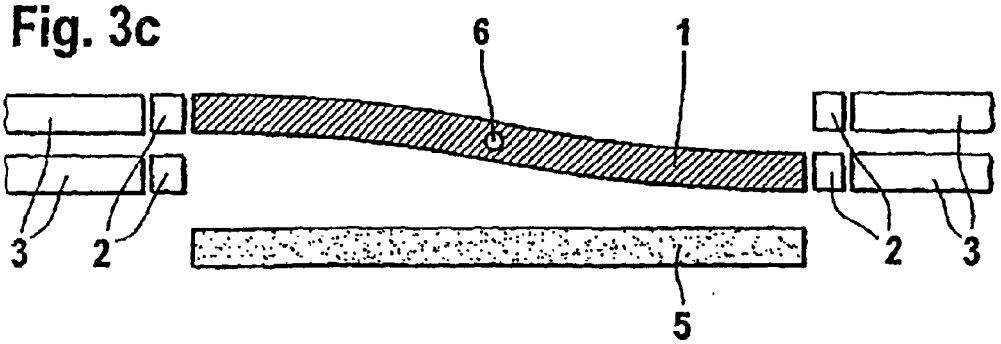
FIG. 3*c* is a top view showing the transition point with shunting points and sliding girder in a first track change function.
Figure 3D:
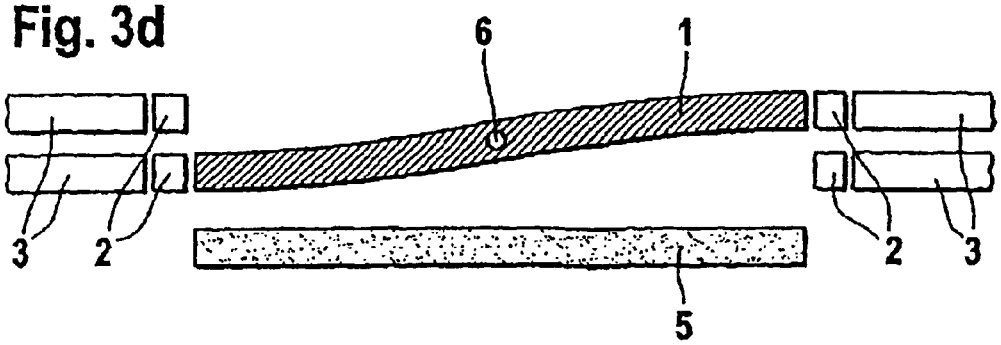
FIG. 3*d* is a top view showing the transition point with shunting points and sliding girder in a second track change function.
Figure 4A:
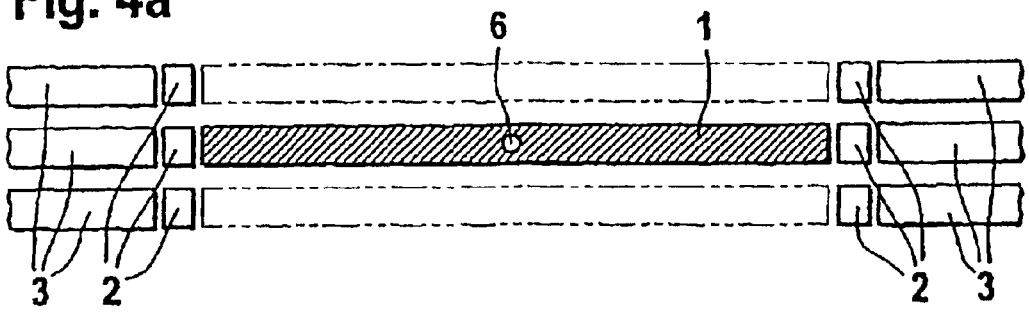
FIG. 4*a* is a top view showing a shunting connection with shunting points in a track connection function for a middle travel track of three parallel ones.
Figure 4B:
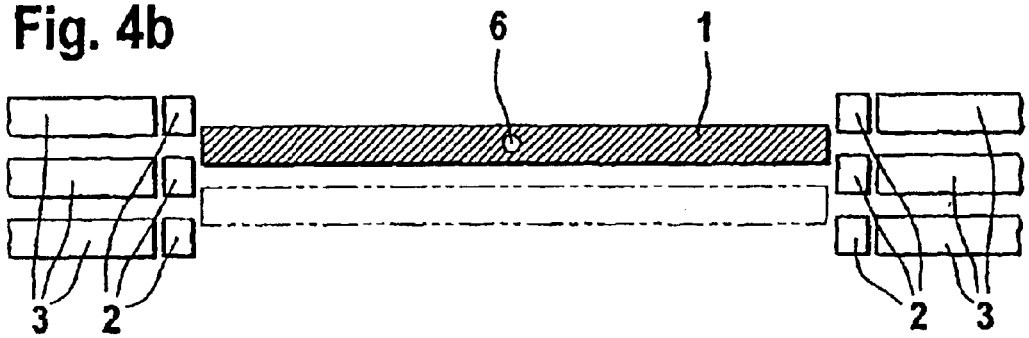
FIG. 4*b* is a top view showing a shunting connection with shunting points in a track connection function for an intermediate position for functional change.
Figure 4C:
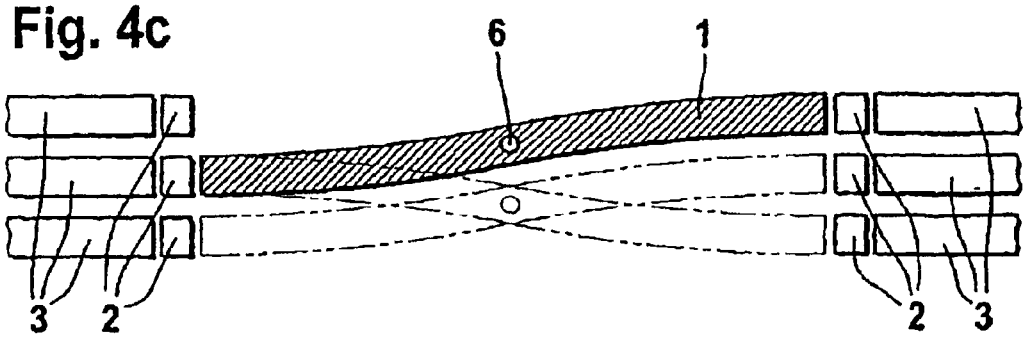
FIG. 4*c* is a top view showing a shunting connection with shunting points in a track connection function for a first track change function from the intermediate position b)
Figure 4D:
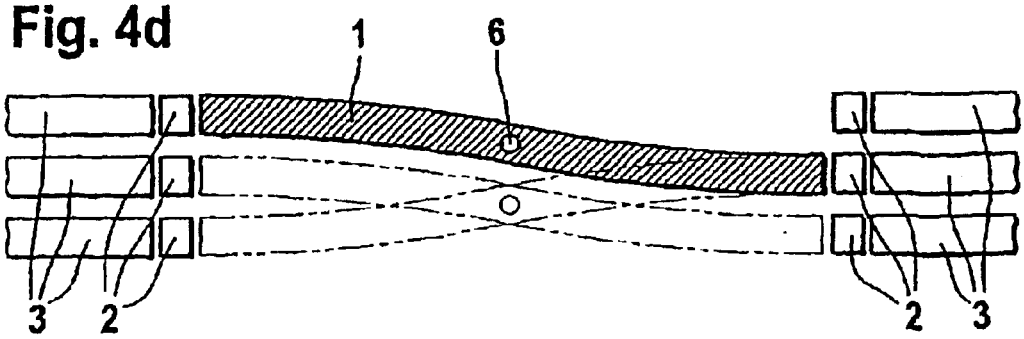
FIG. 4*d* is a top view showing a shunting connection with shunting points in a track connection function for a second track change function from the intermediate position b).

In FIG. 1, the set of bending points 1 at half its length has a fixed bearing 4 that lies on the centerline between the two travel paths 3. The two travel paths 3 are arranged in parallel to each other. The fixed points 7 to 10 according to FIG. 1*a* serve to generate the S-shaped bending curve. This function is fulfilled by fixed points 7' to 10' for the opposite curvature as per FIG. 1 *b*).

As shown in FIGS. 2 to 4, instead of the fixed bearing 4 as per FIG. 1, a so-called bivalent bearing 6 is provided. With the bivalent bearing 6 is a slide so that the bending points 1 can be slid transversely to the longitudinal direction of the travel path. For the track connection as per FIGS. 2*a*, 2*b*, 3*a*, and 4*a* as well as to produce the S-shaped bending points as per FIGS. 2*d*, 2*e*, 3*c* 3*d*, 4*c*, and 4*d*, this bivalent bearing 6 is of course arrested accordingly.

FIGS. 2 and 3 each are principle representations for the double track travel path. FIG. 4 shows principle representations by example of three parallel travel tracks, the number of which can be extended at will. FIG. 3 additionally shows a sliding girder 5, which according to FIG. 3*a* possesses a track connection function. The sliding girder 5 is shifted in parallel outwardly as per FIGS. 3*b* to 3*d* in order to create space for the transversely slidable bending points 1 that has to be brought into the center position.

While specific embodiments of the invention have been shown and described in detail to illustrate the application of the principles of the invention, it will be understood that the invention may be embodied otherwise without departing from such principles.

What is claimed is:

1. A moveable track connection between the ends of travel paths for wrap-around track-guided magnetic levitation railway vehicles, the moveable track connection comprising:

a single track element including a set of S-shaped contiguous deformable bending points for changing track;

a bearing along half the length of said set of S-shaped deformable bending points, said bearing having a vertical axis of rotation which cannot move in the longitudial direction of the bending points.

2. A moveable track connection according to claim 1, wherein said set of bending points provides both as a straight track connection and as an S-shaped bent track change facility.

3. A moveable track connection according to claim 1, wherein said set of bending points can be bent in a S-shape to serve as diamond crossing in both directions.

4. A moveable track connection according to claim 1, wherein said bearing with the vertical axis of rotation is configured as a fixed bearing and configured to be rotationally moveable only around the vertical axis of rotation.

5. A moveable track connection according to claim 1, wherein said bearing is a bivalent bearing sliding transversely to the longitudinal direction of the travel paths and locking in a track connection and change function.

6. A moveable track connection according to claim 5, wherein apart from said bending points there is at least one neighboring straight sliding girder that in a same manner of said set of bending points can be slid transversely to the longitudinal direction of the travel path.

7. A moveable track connection between the ends of travel paths for wrap-around track-guided vehicles, the moveable track connection comprising:

a continuous track element defining a set of S-shaped contiguous deformable bending points for changing track;

a bearing connected to said element between ends of said element, said bearing having a vertical axis of rotation which cannot move in a longitudial direction of the bending points.

8. A moveable track connection according to claim 7, wherein said element with said set of bending points defines both as a straight track connection and as an S-shaped bent track change facility.

9. A moveable track connection according to claim 8, wherein said set of bending points can be bent in a S-shape to serve as diamond crossing in both directions.

10. A moveable track connection according to claim 8, wherein said bearing with the vertical axis of rotation is configured as a fixed bearing and configured to be rotationally moveable only around the vertical axis of rotation:

a slide is connected to said bearing for sliding said bearing as a bivalent bearing transversely to the longitudinal direction of the travel paths and for locking said bearing in a track connection position and in a track change position;

apart from said bending points there is at least one neighboring straight sliding girder that in a same manner of said set of bending points can be transversely to the longitudinal direction of the travel path.

11. A moveable track arrangement comprising:

a continuous track element including a set of contiguous deformable bending points for bending said track element into and out of an S-shape;

a bearing connected to said track element between ends of said track element, said bearing having an axis of rotation around which all of said bending points of said track element can rotate.

12. An arrangement in accordance with claim 11, wherein:

said track element has a longitudinal direction;

said bearing element is fixed in said longitudinal direction.

13. An arrangement in accordance with claim 11, wherein:

said contiguous deformable bending points bend said track element between a substantially straight track and an S-shaped track.

14. An arrangement in accordance with claim 11, wherein:

said contiguous deformable bending points bend said track element between substantially mirror image S-shapes.

15. An arrangement in accordance with claim 11, further comprising:

a first track having a switching gap;

a second track having a switching gap, said track element being arranged in said switching gaps to selectively bridge said switching gap of said first track and to connect said first track with said second track.

16. An arrangement in accordance with claim 15, wherein:

said first track includes first and second abutments on opposite sides of the respective said switching gap;

said second track includes first and second abutments on opposite sides of the respective said switching gap;

said track element is arranged in said switching gaps to selectively connect said first abutment of said first track with said second abutment of said second track;

said track element also being arranged in said switching gaps to selectively connect said first abutment of said second track with said second abutment of said first track.

17. An arrangement in accordance with claim 16, wherein:

said first and second tracks have a longitudinal direction;

said bearing element is substantially fixed in said longitudinal direction.

18. An arrangement in accordance with claim 17, further comprising:

a slide for sliding said bearing between first and second positions in a direction substantially perpendicular to said longitudinal direction.

19. An arrangement in accordance with claim 18, wherein:

said first position of said bearing arranges said track element to selectively connect to said first and second abutments of said first track;

said second position of said bearing arranges said track element to selectively connect to said first abutment of said first track and to said second abutment of said second track.

20. An arrangement in accordance with claim 19, further comprising:

a straight track element slidable with said bearing of said track element into and out of connection with said abutments of said second track.

* * * * *